US010828928B2

(12) United States Patent
Chen

(10) Patent No.: US 10,828,928 B2
(45) Date of Patent: Nov. 10, 2020

(54) WRITING TOOL AND DISPENSING UNIT THEREOF

(71) Applicant: SDI CORPORATION, Chang Hua (TW)

(72) Inventor: Szu-Yu Chen, Chang Hua (TW)

(73) Assignee: SDI CORPORATION, Chang Hua (TW)

( * ) Notice: Subject to any disclaimer, the term of this patent is extended or adjusted under 35 U.S.C. 154(b) by 193 days.

(21) Appl. No.: 15/789,664

(22) Filed: Oct. 20, 2017

(65) Prior Publication Data

US 2018/0333979 A1 Nov. 22, 2018

(30) Foreign Application Priority Data

May 19, 2017 (TW) ..... 106116658 A

(51) Int. Cl.
*B43K 5/18* (2006.01)
*B43K 8/03* (2006.01)
(Continued)

(52) U.S. Cl.
CPC ..... *B43K 5/18* (2013.01); *B43K 1/003* (2013.01); *B43K 5/14* (2013.01); *B43K 8/03* (2013.01)

(58) Field of Classification Search
CPC ... B43K 5/18; B43K 7/01; B43K 7/02; B43K 7/10; B43K 8/04; B43K 8/06; B43K 8/08;
(Continued)

(56) References Cited

U.S. PATENT DOCUMENTS 1,406,903 A * 2/1922 Rose ..... B05B 11/062 222/82
1,406,904 A * 2/1922 Rose ..... B05B 11/062 222/82
(Continued)

FOREIGN PATENT DOCUMENTS

CN 2340617 Y 9/1999
CN 1749029 A 3/2006
(Continued)

OTHER PUBLICATIONS

Extended European search report.
RU Substantive Examination.
IPOPHL's search report.

*Primary Examiner* — Paul R Durand
*Assistant Examiner* — Randall A Gruby
(74) *Attorney, Agent, or Firm* — Rabin & Berdo, P.C.

(57) ABSTRACT

A writing tool includes a writing unit, a capillary member, a dispensing unit, and a replaceable ink cartridge. The capillary member, the dispensing unit, and the replaceable ink cartridge are mounted in the writing unit. The dispensing unit contacts the capillary member and has at least one cutting portion. The replaceable ink cartridge accommodates ink therein and has a film at one end thereof. The replaceable ink cartridge can be installed in the dispensing unit and the film can be pierced and cut by the at least one cutting portion. The ink flows through the film and is delivered to the writing unit via the capillary member and the dispensing unit for writing. The writing tool can thus dispense the ink fluently and leave no residual ink.

16 Claims, 12 Drawing Sheets

(51) Int. Cl.
*B43K 1/00* (2006.01)
*B43K 5/14* (2006.01)

(58) Field of Classification Search
CPC ..... A46B 11/0075; B05C 17/00586; A61M 35/006
See application file for complete search history.

(56) References Cited

U.S. PATENT DOCUMENTS 1,712,141 A 5/1929 Folk
2,045,774 A * 6/1936 Hirschy ..... B43K 5/145 401/133
2,229,749 A * 1/1941 Little ..... B43K 5/14 401/135
2,587,683 A * 3/1952 Barry ..... B05C 17/00586 222/89
2,620,773 A * 12/1952 Tefft ..... B43K 7/02 401/135
2,736,292 A * 2/1956 Tanberg ..... B43K 5/18 401/135
2,785,656 A * 3/1957 Del Piero ..... B43K 5/14 401/135
2,802,448 A 8/1957 Young
2,870,742 A * 1/1959 Hackmyer ..... B43K 7/03 401/135
2,919,677 A * 1/1960 Mansheim ..... B43K 5/14 401/135
2,961,999 A * 11/1960 Torchi ..... B43K 5/14 401/45
3,040,708 A * 6/1962 Simon, Jr. ..... B43K 5/14 401/135
3,056,194 A 10/1962 Kahn
3,066,652 A * 12/1962 Brown ..... B43K 5/14 401/134
3,087,463 A * 4/1963 Kahn ..... B43K 5/04 401/135
3,134,362 A * 5/1964 Green ..... B43K 5/06 401/135
3,145,412 A * 8/1964 Levy ..... B43K 5/1845 401/135
3,167,056 A * 1/1965 Bross ..... B43K 5/14 401/135
3,234,918 A * 2/1966 Gigli ..... B43K 5/14 401/134
3,399,019 A * 8/1968 Koelichen ..... B43K 8/16 401/134
3,501,225 A * 3/1970 Martin ..... B43K 5/18 401/198
3,687,561 A 8/1972 Phillips
3,802,604 A * 4/1974 Morane ..... B65D 51/28 222/83
3,812,992 A * 5/1974 Wolf ..... A61J 9/00 215/253
3,901,608 A * 8/1975 Phillips ..... B43K 5/18 401/135
3,922,099 A * 11/1975 Christine ..... A23G 3/28 401/134
4,139,313 A * 2/1979 Hori ..... B43K 7/105 401/216
4,206,714 A * 6/1980 Walsh ..... A01C 5/02 111/92
4,341,328 A * 7/1982 Redick, Jr. ..... B67B 7/28 222/108
4,415,288 A * 11/1983 Gordon ..... A47K 7/028 401/132
4,498,796 A * 2/1985 Gordon ..... A47K 7/028 401/132
4,722,449 A * 2/1988 Dubach ..... B65D 51/227 215/235
4,781,484 A * 11/1988 Goncalves ..... B65D 51/2835 401/132
4,925,327 A * 5/1990 Wirt ..... A61M 35/006 401/132
4,997,301 A * 3/1991 Sheu ..... B43K 5/02 401/133
5,017,035 A 5/1991 Peters et al.
5,342,136 A 8/1994 Fukami
5,875,928 A * 3/1999 Muller ..... B05C 17/00553 222/137
6,086,279 A * 7/2000 Yen ..... B43K 23/08 401/198
6,629,798 B1 * 10/2003 Fukami ..... B43K 8/06 401/199
7,926,682 B2 * 4/2011 Nelson ..... B01F 15/0205 141/330
8,550,737 B2 * 10/2013 Ruiz, Sr. ..... A61B 17/00491 401/134
10,219,793 B2 * 3/2019 Quintero ..... A61B 17/00491
10,569,594 B2 * 2/2020 Chen ..... B43K 8/022
2006/0054036 A1 3/2006 Kurita et al.
2008/0245314 A1 * 10/2008 Brodowski ..... A01N 25/34 119/651
2015/0044370 A1 2/2015 Albenge et al.
2015/0298487 A1 10/2015 Prigent et al.
2015/0298488 A1 * 10/2015 Masuda ..... B43K 7/02 401/209
2016/0106964 A1 * 4/2016 Quaglia ..... A61M 35/003 604/310
2018/0186172 A1 * 7/2018 Kurita ..... B43K 8/04
2019/0168252 A1 * 6/2019 Springhorn ..... B05C 17/00513
2020/0062977 A1 * 2/2020 Schwarz ..... C09D 11/037
2020/0230996 A1 * 7/2020 Hori ..... B43K 8/02

FOREIGN PATENT DOCUMENTS

CN 202895998 U 4/2013
EP 0570866 A1 11/1993
EP 2977224 A1 1/2016
EP 3050712 A1 8/2016
GB 878117 A 9/1961
GB 900300 A 7/1962
JP 374008 3/1962
JP 473853 2/1972
JP 143946 11/1990
JP H02137973 U 11/1990
JP 280999 3/1992
JP 2001524896 A 12/2001
KR 20140043381 A 4/2014
TW 201511981 A 4/2015
WO 9515265 A1 6/1995
WO WO-2008074202 A1 6/2008
WO 2015041202 A1 3/2015

* cited by examiner

WRITING TOOL AND DISPENSING UNIT THEREOF

BACKGROUND OF THE INVENTION

1. Field of the Invention

The present invention relates to writing stationery, and particularly to a writing tool and a dispensing unit thereof.

2. Description of Related Art

EPO Publication No. 0570866 discloses a writing instrument with an exchangeable ink refill. The ink refill of the writing instrument stores ink by an internal wadding, i.e. the ink is not stored directly in the liquid state inside the ink refill. A pointed member is mounted at one end of an ink dispensing unit to pierce through a film on the ink refill. Therefore, when the film on the ink refill is pierced by the pointed member to form a tiny opening, the ink dispensing unit can be connected with the internal wadding to deliver the ink in the ink refill via the tiny opening. Because the opening is too small and the ink in the ink refill is stored in the internal wadding, the ink-delivering efficiency of the ink dispensing unit is not high and some of the ink tends to remain in the ink refill.

TW Publication No. 201511981 discloses a conventional writing implement with a replaceable ink cartridge. Ink inside the ink cartridge can be dispensed after a plug located at a bottom end of the ink cartridge is pressed to open the ink cartridge. As shown in FIGS. 4 to 6 of the '981 patent publication, an embodiment discloses that a protrusion formed on and protruding from a main body of the conventional writing implement can press the plug, and then the plug is displaced to open the bottom end of the replaceable ink cartridge, so the ink can be delivered from the replaceable ink cartridge to the main body of the conventional writing implement.

Another embodiment shown in FIG. 11 of the '981 patent publication discloses that a protrusion formed on and protruding from the main body of the conventional writing implement is pushed against the plug. The plug of the replaceable ink cartridge is made of a hard material to be not easily destructible. Therefore, when the plug is pushed by the protrusion, the plug will be overturned to open the replaceable ink cartridge and the ink can be delivered from the ink cartridge to the main body of the conventional writing implement.

As inferred from the above, when the plug is displaced or overturned, the movement of the plug may block the replaceable ink cartridge accidently to result in unsmooth delivery of the ink. Besides, with reference to the embodiment indicated in FIG. 11 of the '981 patent publication, the protrusion is too close to an internal periphery of the replaceable ink cartridge, so the replaceable ink cartridge may easily interfere with the protrusion in the process of installing the ink cartridge into the conventional writing implement, making the process not smooth.

When the aforesaid conventional ink-exchangeable writing tool is operated to replace its ink cartridge, an ink dispensing unit or a main body of the writing tool is used to deliver the ink by piercing a film or pushing a plug. Taking the former as an example, an opening being formed on the film is too small to be advantageous to delivery of the ink. Taking the latter as an example, the plug being displaced or overturned may block the delivery of the ink. Thus, either will cause unfavorable delivery of the ink.

To overcome the shortcomings of the conventional writing tools, the present invention provides a writing tool and a dispensing unit thereof.

SUMMARY OF THE INVENTION

To solve the problems that the conventional writing tools with the exchangeable ink cartridges each have an adverse effect on ink delivery, the present invention provides a writing tool and a dispensing unit thereof which can lead to a high volume of ink delivery and complete outflow of the ink. Therefore, the present invention has a favorable effect on ink delivery and does not tend to have residual ink.

The writing tool further includes a writing unit, a capillary member, and a replaceable ink cartridge. The writing unit has a tube and a nib mounted at one end of the tube. The capillary member, the dispensing unit, and the replaceable ink cartridge are mounted in the tube. The capillary member has one end abutting against the nib. The dispensing unit has an inbound part, an outbound part, and a dispensing passage communicating with the inbound part and the outbound part. The outbound part abuts against the capillary member. The inbound part has at least one cutting portion, a first coupling portion surrounding the at least one cutting portion, and at least one external passage defined between the at least one cutting portion and the first coupling portion. The at least one cutting portion has at least one cutting edge at a top thereof.

The replaceable ink cartridge has a second coupling portion, ink, and a film. The second coupling portion can be connected with the first coupling portion. The ink is contained inside the ink cartridge. The film can be pierced and cut by the cutting portion to form an outlet for output of the ink.

Preferably, the at least one cutting edge further includes at least one first end and at least one second end, and a height difference is defined vertically between the at least one first end and the at least one second end.

Preferably, the first coupling portion further comprises an abutting edge annularly formed at an outer periphery thereof, an assembly stroke is an axial distance defined between the abutting edge and an uppermost side of the first coupling portion, and the assembly stroke is larger than the height difference of the at least one cutting portion.

Preferably, the dispensing unit further includes two or more said cutting portions arranged annularly and spaced at intervals.

Preferably, each of the cutting edges of the cutting portions is curved and inclined from the at least one first end to the at least one second end.

Preferably, the dispensing passage is provided with an internal passage surrounded by the at least one cutting portion and communicating with the external passage via at least one guiding gap.

Preferably, the first coupling portion of the inbound part includes at least one sealing rib, and an outer diameter of the at least one sealing rib is not smaller than an inner diameter of the second coupling portion.

Preferably, the writing tool further includes a cap sleeved onto the replaceable ink cartridge for rotatably driving and enabling the replaceable ink cartridge to be installed into the tube.

Preferably, the cap further includes a plurality of push lugs formed annularly at a lowermost side thereof and spaced at intervals, the second coupling portion includes a plurality of abutting ribs formed annularly at an outer periphery of the replaceable ink cartridge and spaced at intervals, and the cap rotatably drives and enables the replaceable ink cartridge into the tube in such a way that the push lugs are pushed against the abutting ribs, respectively.

DETAILED DESCRIPTION OF PREFERRED EMBODIMENT

First of all, directional references, such as "outer", "inner", "external", "internal", "outward", "inward", "downward", "upward", "top", "bottom", "uppermost", "lowermost", "anterior", and the like, are only used based on conventional orientation of the drawings for identification purposes to facilitate the reader to understand the present invention by reference to the drawings and do not limit the associated elements, particularly as to the position, orientation, or use of this disclosure. Also, a person skilled in the art should notice this description may contain other terminology to convey position, orientation, and direction without departing from the principles of the present invention.

Figure 1:
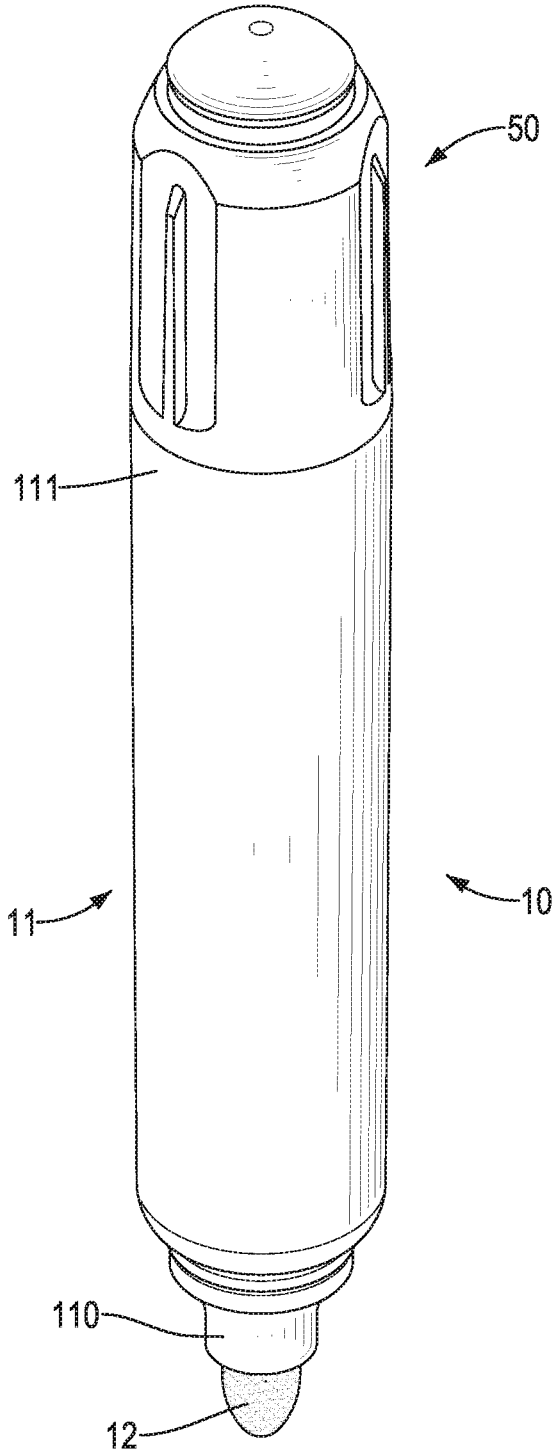
FIG. 1 is a perspective view of a first embodiment of a writing tool in accordance with the present invention.
Figure 2:
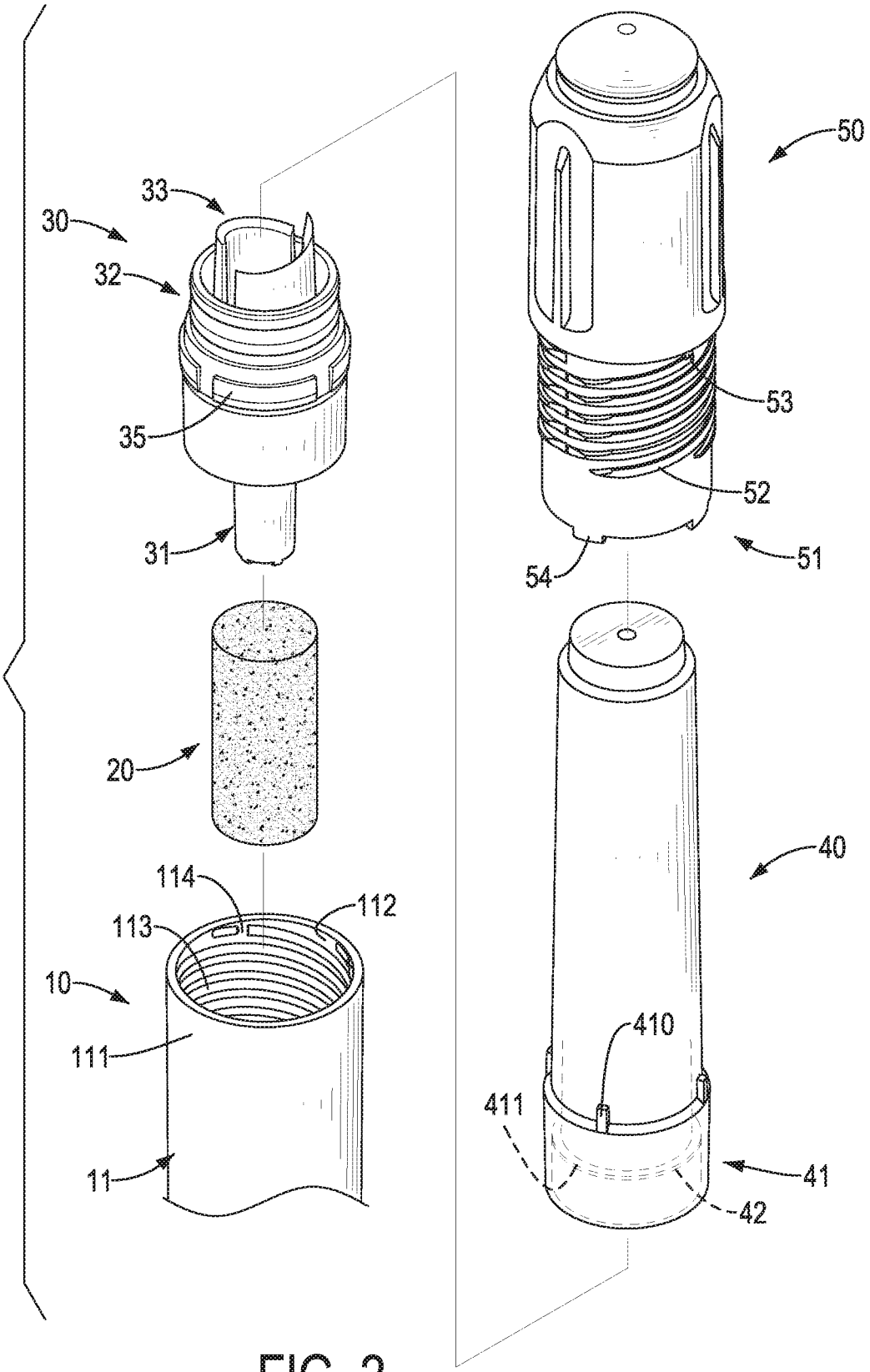
FIG. 2 is an exploded perspective view of a part of the writing tool shown in FIG. 1.

With reference to FIGS. 1 and 2, a writing tool constructed in accordance with a first embodiment of the present invention includes a writing unit 10, a capillary member 20, a dispensing unit 30, a replaceable ink cartridge 40, and a cap 50.

The writing unit 10 includes a tube 11 and a nib 12. The tube 11 is cylindrical and has a head portion 110, a tail portion 111, and an assembling space 112 formed internally between the head portion 110 and the tail portion 111. A plurality of internal threads 113 protrude and extend spirally from an inner periphery of the tail portion 111. A plurality of discontinuities 114 are formed at anterior ends of the internal threads 113, respectively, for positioning the cap 50. The nib 12 is mounted to the head portion 110 of the tube 11 for dispensing ink (not shown) to write.

As shown in FIG. 2, the capillary member 20 is mounted in the assembling space 112 of the tube 11 and has one end contacting a distal end of the nib 12. The capillary member 20 is made of a cotton-based material for temporary storage and occlusion of ink (not shown).

Figure 3:
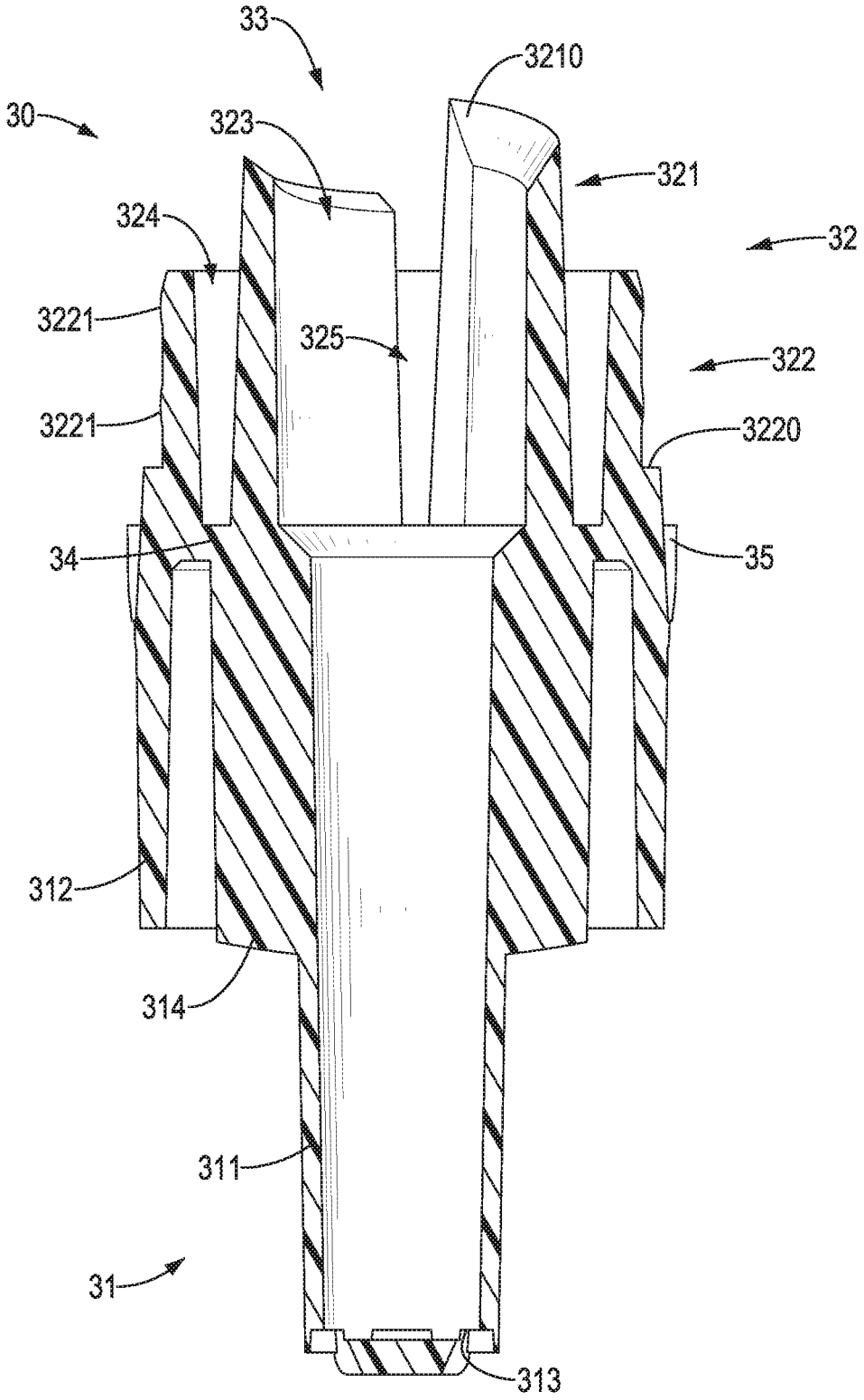
FIG. 3 is a sectional view of a dispensing unit of the writing tool shown in FIG. 1.

Referring to FIG. 3 in view of FIG. 2, the dispensing unit 30 is mounted in the assembling space 112 of the tube 11 and abuts against one end of the capillary member 20. The dispensing unit 30 includes an outbound part 31, an inbound part 32, and a dispensing passage 33 communicating with the outbound part 31 and the inbound part 32. A partition plate 34 is formed between the inbound part 32 and the outbound part 31 for making the outbound part 31 and the inbound part 32 two opposite ends of the dispensing passage 33. The outbound part 31 has an ink guiding tube 311, an outer annular portion 312, a plurality of guiding outlets 313, and a plurality of baffles 314. The ink guiding tube 311 and the outer annular portion 312 extend downwardly from the partition plate 34, respectively. The ink guiding tube 311 extends lengthwise downwardly and goes beyond the outer annular portion 312. The outer annular portion 312 surrounds the ink guiding tube 311. The guiding outlets 313 are annularly or radially formed at a bottom end of the ink guiding tube 311 for outwardly guiding the ink from the ink guiding tube 311. The baffles 314 are formed between the ink guiding tube 311 and the outer annular portion 312 and arranged at equal intervals. Each of the baffles 314 protrudes from the ink guiding tube 311 and extends axially along the ink guiding tube 311 toward outside from the partition plate 34, being axially slightly longer than the outer annular portion 312. The baffles 314 are used for pushing against the capillary member 20.

Figure 4:
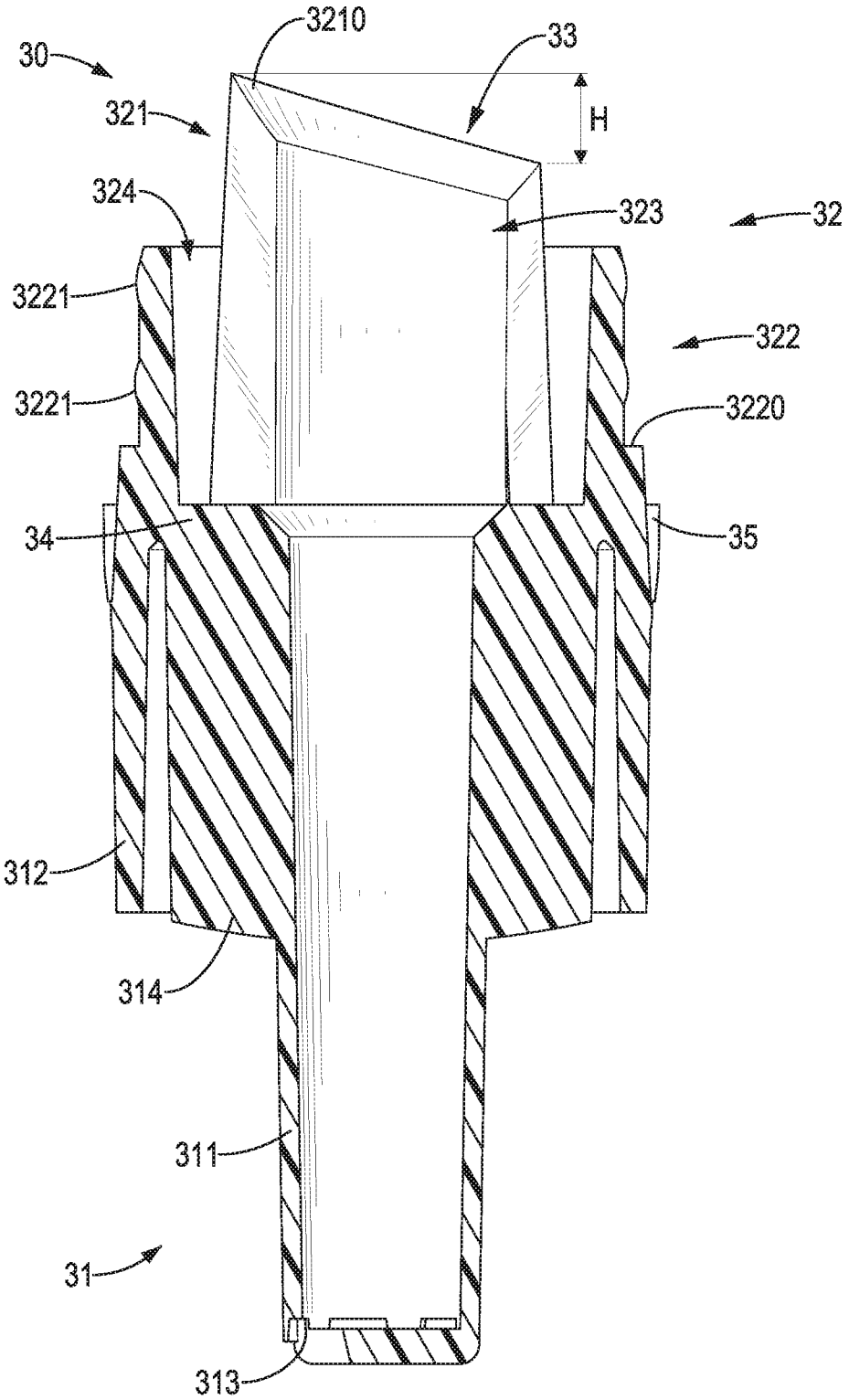
FIG. 4 is another sectional view of the dispensing unit of the writing tool shown in FIG. 1.

Referring to FIG. 4 in view of FIGS. 2 and 3, the inbound part 32 has two cutting portions 321, a first coupling portion 322, an internal passage 323, an external passage 324, and two guiding gaps 325. Each of the cutting portions 321 extends upwardly from the partition plate 34. The first coupling portion 322 is annularly formed around the cutting portions 321. The two cutting portions 321 are located opposite to each other and can be, in a cross-sectional view, symmetrically or asymmetrically curved. Each of the cutting portions 321 has a cutting edge 3210 formed on an uppermost side of the cutting portion 321. Each of the cutting edges 3210 is sharp and extends continuously along a lengthwise direction thereof. Each of the cutting edges 3210 has at least one first end and at least one second end. A height difference H is defined vertically between the first end and the second end for each of the cutting edges 3210.

In the first embodiment of the present invention, each of the cutting edges 3210 of the cutting portions 321 is curved and inclined downwardly clockwise from the first end to the second end of the cutting edge 3210. Alternatively, each of the cutting edges 3210 of the cutting portions 321 can be curved and inclined downwardly counterclockwise from the first end to the second end of the cutting edge 3210. Lengths of the cutting edges 3210 of the cutting portions 321 can be equal or unequal to each other. In the first embodiment of the present invention, the lengths of the cutting edges 3210 of the cutting portions 321 are unequal to each other, i.e. the length of the cutting edge 3210 of one said cutting portion 321 is larger than that of the other cutting edge 3210. This structure can accurately keep a film (not shown) of an ink cartridge (not shown) from disengaging from the ink cartridge after the cutting edges 3210 annularly pierce and cut the film.

As shown in FIGS. 2 and 3, the internal passage 323 is surrounded by the cutting portions 321 and communicates with the ink guiding tube 311. The external passage 324 is defined between the cutting portions 321 and the first coupling portion 322. Each of the two guiding gaps 325 is formed between adjacent sides of the cutting portions 321 and communicates with the internal passage 323 and the external passage 324. Ink (not shown) can be guided and delivered through the guiding gaps 325. The first coupling portion 322 of the inbound part 32 has an abutting edge 3220 and two sealing ribs 3221. The abutting edge 3220 is annularly formed at an outer periphery of the first coupling portion 322 and is connected with the outer annular portion 312. The two sealing ribs 3221 are annularly formed at the outer periphery of the first coupling portion 322.

An assembly stroke L is defined axially between the abutting edge 3220 and an uppermost end of the first coupling portion 322. The assembly stroke L is larger than the height difference H. The dispensing unit 30 further has a plurality of elongated engaging convexities 35 formed annularly at the outer periphery of the first coupling portion 322 and located between the abutting edge 3220 and the outer annular portion 312. The engaging convexities 35 enable the dispensing unit 30 to be engaged with the tube 11 to prevent the dispensing unit 30 from disengaging from the tube 11. The dispensing passage 33 is defined to include an inner space of the ink guiding tube 311 of the outbound part 31 and the internal passage 323 of the inbound part 32 for delivery of ink (not shown) to the capillary member 20.

Figure 6:
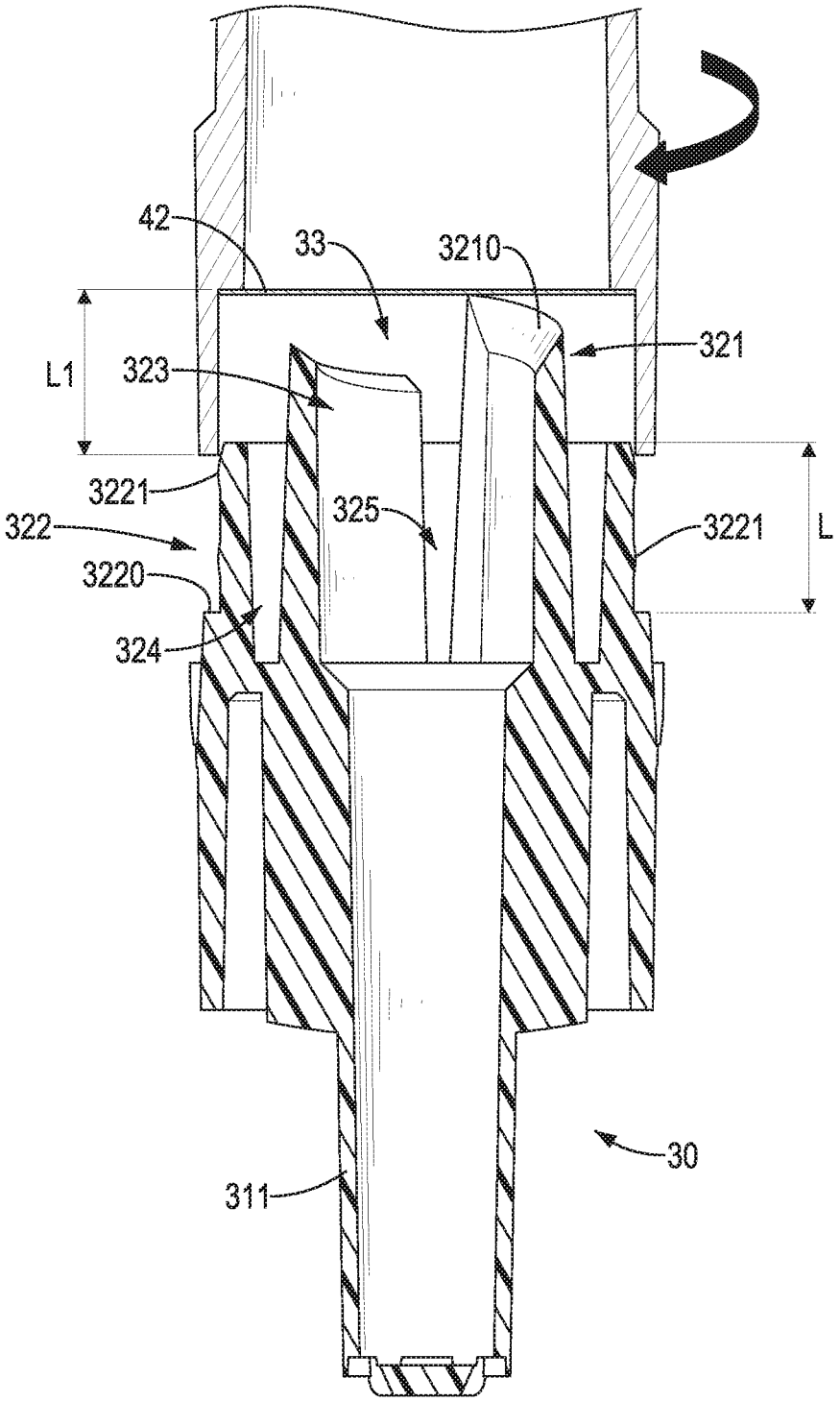
FIG. 6 is an enlarged and sectional view of a part of the writing tool in operation, showing that a film of the replaceable ink cartridge is to be cut in the process of rotatably installing the replaceable ink cartridge into the dispensing unit.

As shown in FIGS. 2 and 6, the replaceable ink cartridge 40 is mounted in the assembling space 112 and the cap 50 and communicates with the dispensing unit 30. The replaceable ink cartridge 40 is tubular and has ink (not shown) stored therein, a second coupling portion 41, and a film 42. The second coupling portion 41 is formed at one end of the replaceable ink cartridge 40. The replaceable ink cartridge 40 is connected with the dispensing unit 30 in such a way that the second coupling portion 41 is sleeved onto the first coupling portion 322. Outer and inner diameters of the second coupling portion 41 are larger than those of other parts of the replaceable ink cartridge 40. The outer diameter of each said sealing rib 3221 can be larger than or equal to the inner diameter of the second coupling portion 41. Preferably, the outer diameter of each said sealing rib 3221 is larger than the inner diameter of the second coupling portion 41. The second coupling portion 41 has a plurality of abutting ribs 410 and a stepped edge 411. The abutting ribs 410 are annularly arranged at an outer periphery of the replaceable ink cartridge 40 at equal intervals and extend upwardly from an uppermost end of the second coupling portion 41. The stepped edge 411 is annularly formed at an inner periphery of the second coupling portion 41. A sleeving stroke L1 is defined between the stepped edge 411 and a lowermost end of the second coupling portion 41. The sleeving stroke L1 is substantially as long as the assembly stroke L. Referring to FIGS. 2 and 6 again, the film 42 is made of a soft material and mounted to the stepped edge 411 of the second coupling portion 41 by heat sealing. Preferably, the film 42 is made of polyethylene (PE) and aluminum foil, so the film 42 can be preferably adhered to the replaceable ink cartridge 40 and has great expandability. The ink is sealed inside the replaceable ink cartridge 40 by the film 42. When the film 42 is pierced and cut by either of the cutting portions 321 of the dispensing unit 30, the ink can flow outwardly from the second coupling portion 41 and be guided to the dispensing unit 30, so that the dispensing passage 33 and the replaceable ink cartridge 40 can communicate with each other.

Referring to FIGS. 1 and 2 again, the cap 50 is sleeved onto the replaceable ink cartridge 40 and is threadably mounted in the assembling space 112 of the tube 11. The cap 50 is hollow and has an assembling segment 51, a plurality of external threads 52, a plurality of engaging ribs 53, and a plurality of push lugs 54. The assembling segment 51 is tubular and has a shape corresponding to that of the assembling space 112. The external threads 52 are spirally formed on the assembling segment 51, corresponding to the internal threads 113, respectively. The engaging ribs 53 are formed and annularly arranged at uppermost ends of the external threads 52, respectively, corresponding to the discontinuities 114 in location. The push lugs 54 are formed and annularly arranged at a lowermost side of the assembling segment 51 at equal intervals, corresponding to the abutting ribs 410 in location, respectively.

How the first embodiment of the present invention is operated is shown in FIGS. 5 to 9, indicating a process of installing the replaceable ink cartridge 40 by means of threaded connection. When the replaceable ink cartridge 40 of the writing tool runs out of ink (not shown), the replaceable ink cartridge 40 can be removed from the writing tool and replaced by another fresh replaceable ink cartridge (not shown) as recited hereinafter.

First of all, put the replaceable ink cartridge 40 into the assembling space 112 of the tube 11, sleeve the cap 50 onto the replaceable ink cartridge 40, and then screw the cap 50 into the tube 11 gradually in such a way that the external threads 52 of the cap 50 engage the internal threads 113 of the tube 11. After the abutting ribs 410 of the replaceable ink cartridge 40 are moved to contact the lowermost side of the assembling segment 51, the abutting ribs 410 can push the push lugs 54, respectively, to drive the replaceable ink cartridge 40 to move spirally downwardly along with the cap 50.

After that, the second coupling portion 41 of the replaceable ink cartridge 40 is initially sleeved onto the first coupling portion 322 of the dispensing unit 30 and meanwhile, the first end of each said cutting portion 321 is pushed against the film 42, and the second coupling portion 41 engages the uppermost sealing rib 3221 to seal the second coupling portion 41 and the first coupling portion 322, so none of any gap is formed between the second coupling portion 41 and the first coupling portion 322. In this way, the ink can be prevented from leaking out from the second coupling portion 41 or the first coupling portion 322 when the film 42 is accidentally pierced. When the replaceable ink cartridge 40 is further driven to move downwardly by the cap 50, the second coupling portion 41 can be forced to pass the two sealing ribs 3221 and finally the stepped edge 411 abuts against the abutting edge 3220. In the meantime, referring to FIG. 2 again in view of FIG. 5, the engaging ribs 53 of the cap 50 are engaged with the discontinuities 114, so the cap 50 and the tube 11 are fixedly connected with each other.

Figure 7:
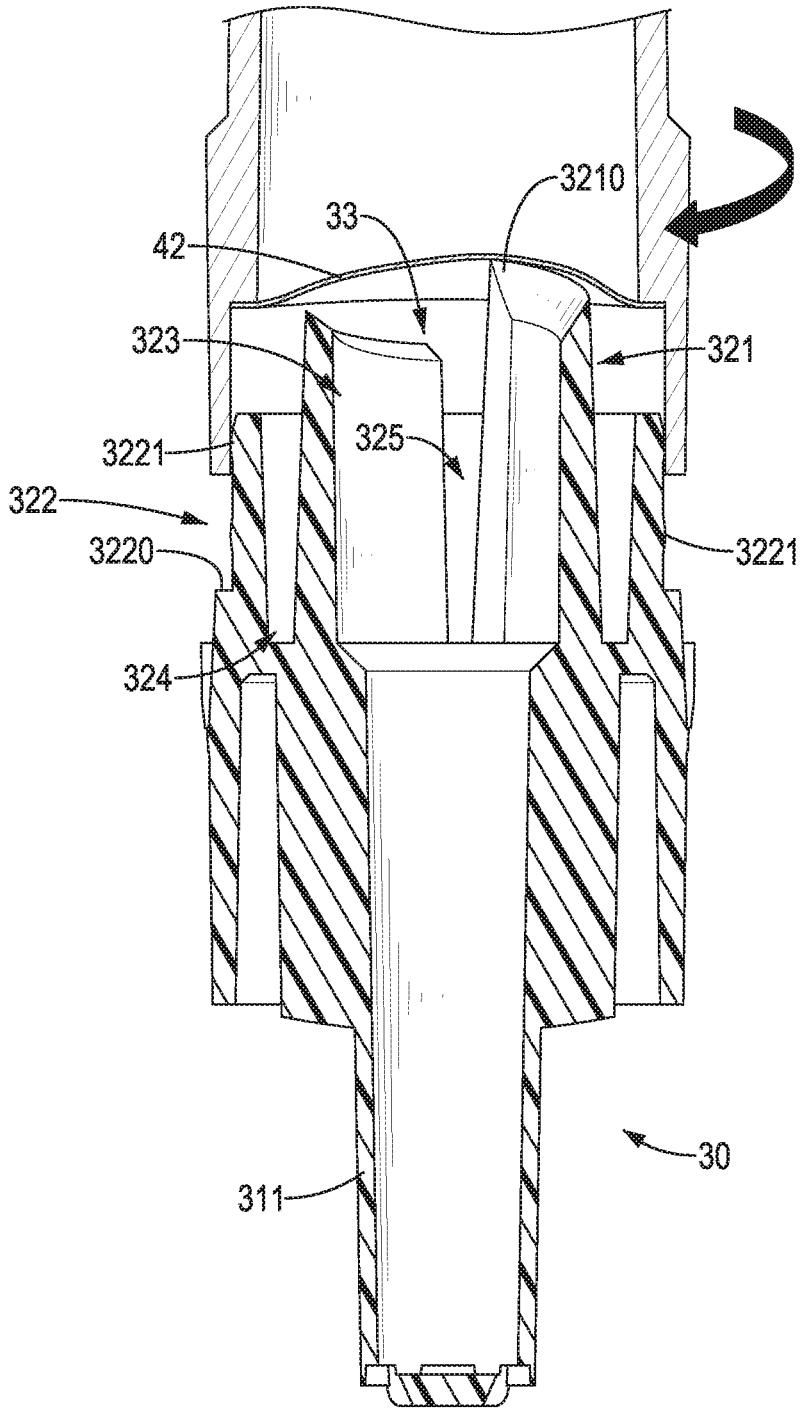
FIG. 7 shows that the film of the replaceable ink cartridge is being cut in the process of rotatably installing the replaceable ink cartridge into the dispensing unit.
Figure 8:
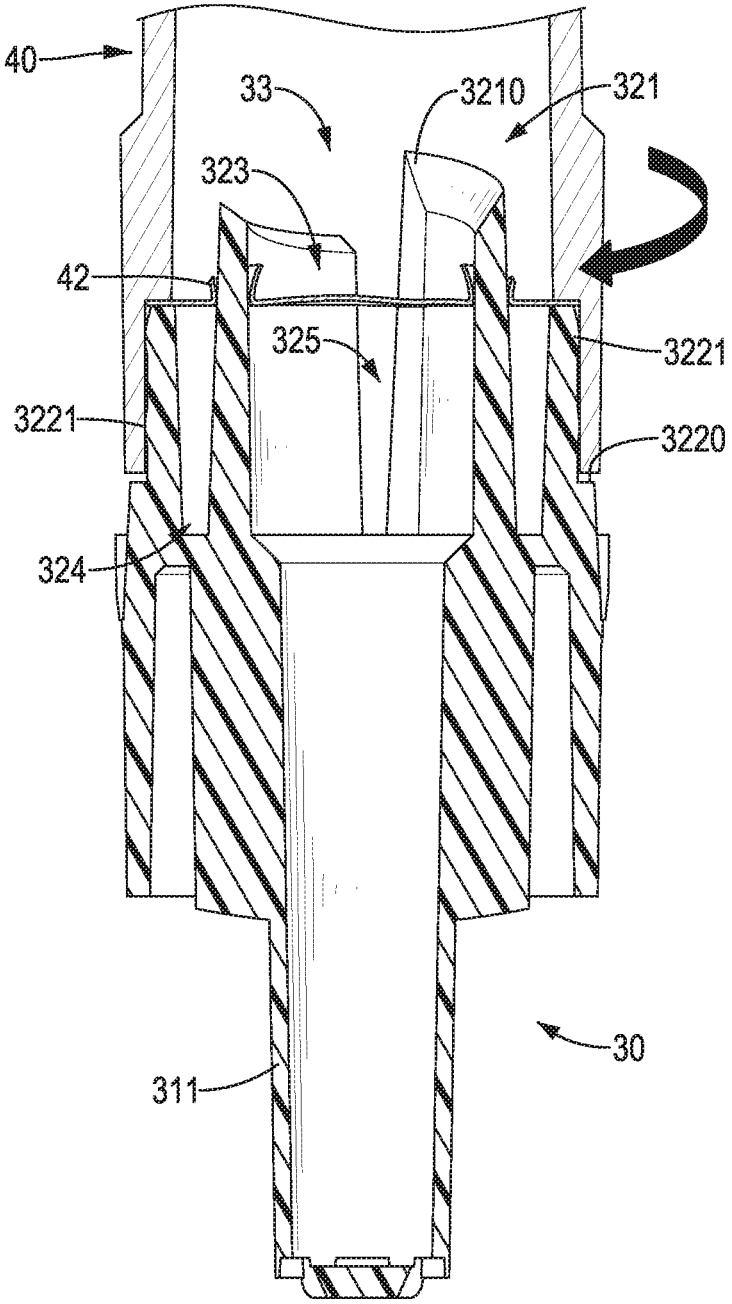
FIG. 8 shows that the film has been cut in the process of rotatably installing the replaceable ink cartridge into the dispensing unit.

As shown in FIGS. 6 to 8, when the replaceable ink cartridge 40 is driven to move downwardly by the cap 50, the film 42 of the replaceable ink cartridge 40 is gradually moved to the cutting edge 3210 of each said cutting portion 321 until either or both of the first ends of the cutting edges 3210 pierce and cut the film 42.

Figure 9:
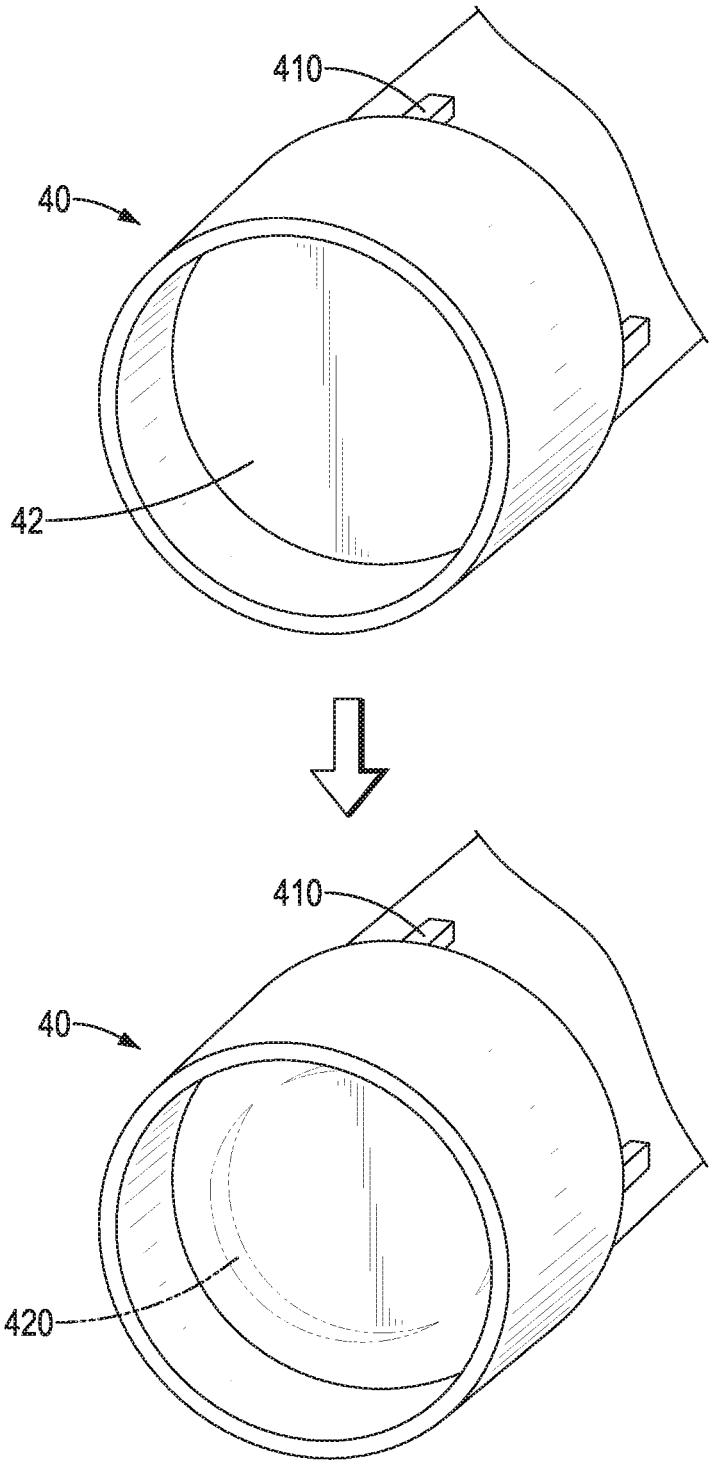
FIG. 9 is a schematic view of a part of the replaceable ink cartridge, showing statuses of the film of the replaceable ink cartridge before and after the film is cut.

As shown in FIGS. 8 and 9, a stroke of the cap 50 is limited by the internal thread 113 of the tube 11, so when the replaceable ink cartridge 40 is rotated for an angle about 180 degrees, the film 42 of the replaceable ink cartridge 40 will be cut by the cutting edges 3210 of the two cutting portions 321 to form two curved outlets 420, respectively. However, two ends of either of the two curved outlets 420 do not completely overlap those of the other, so the whole film 42 still remains on the stepped edge 411 and blocks none of the internal passage 323 and the external passage 324 of the dispensing unit 30. In this way, the ink flows into the dispensing passage 33 of the dispensing unit 30 from the replaceable ink cartridge 40. As shown in FIGS. 1 to 3, the ink is guided to the capillary member 20 and the nib 12 via the outbound part 31, so the ink can be dispensed fluently for smooth writing. Partial ink may though flow into the external passage 324, but the ink flowing into the external passage 324 can be guided back to the internal passage 323 through the guiding gaps 325, so the ink is not subject to stagnation in the inbound part 32.

Figure 5:
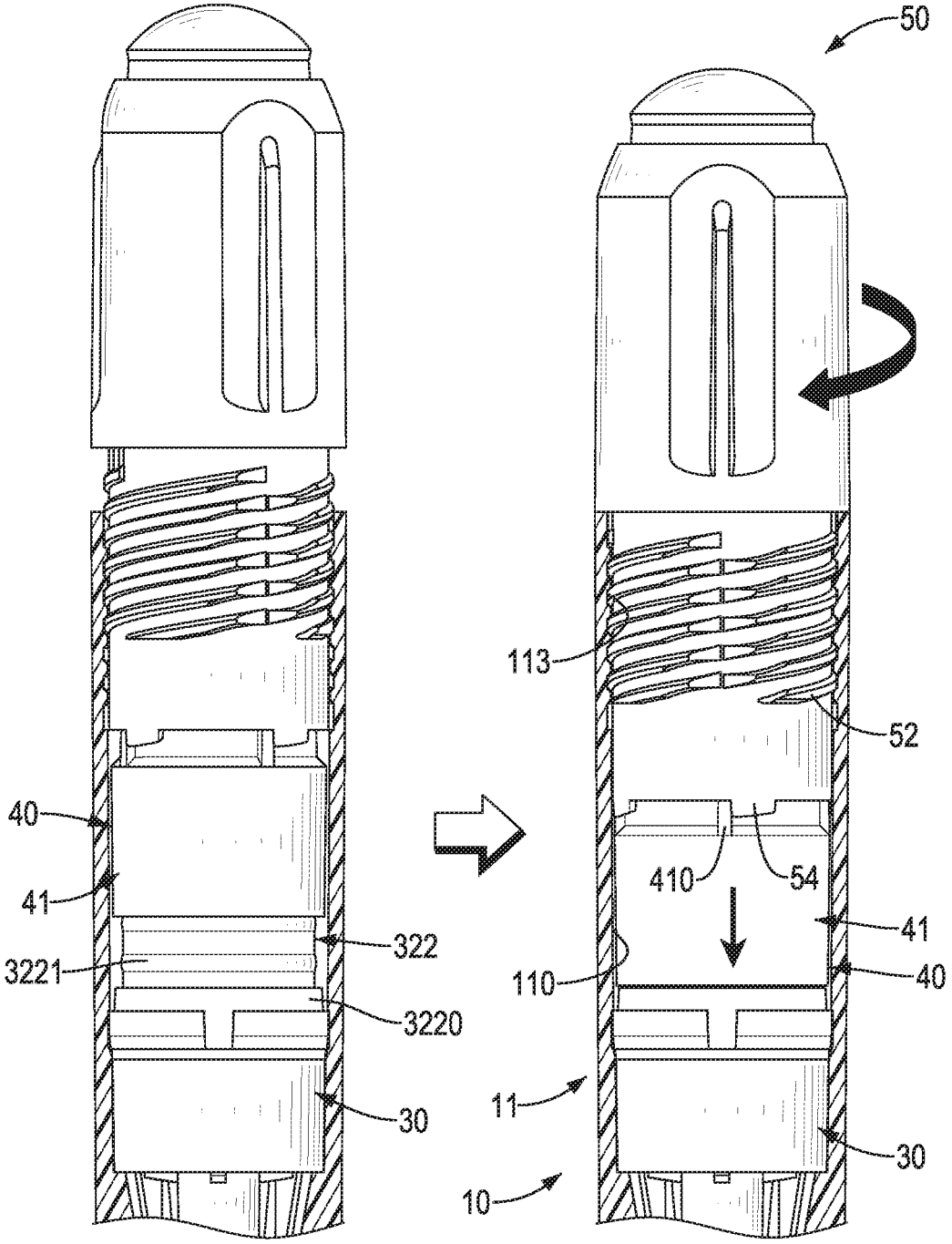
FIG. 5 is a schematic view of a part of the writing tool in operation, showing that a cap rotatably drives and enables a replaceable ink cartridge to be installed in a dispensing unit.
Figure 10:
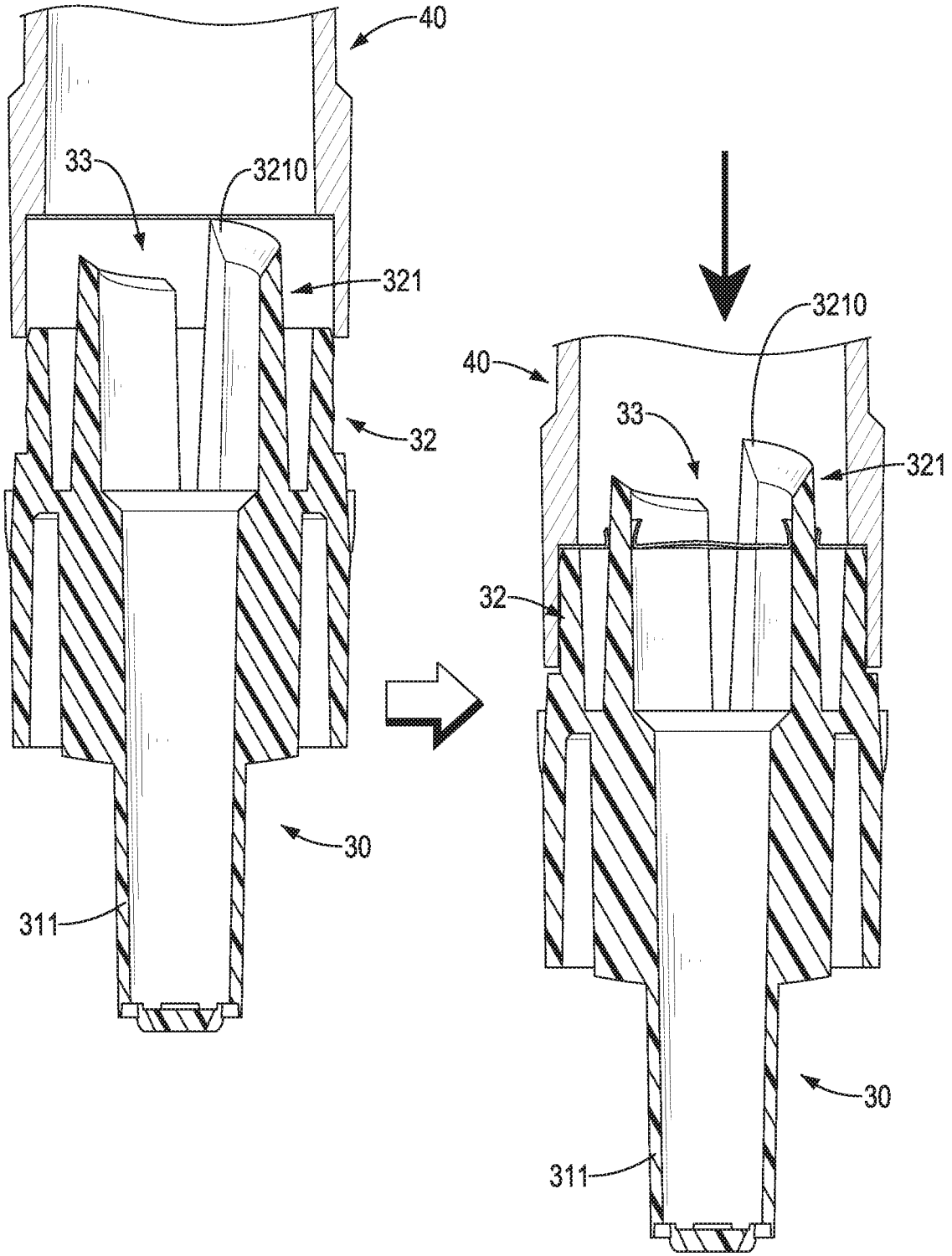
FIG. 10 is another sectional view of the writing tool, showing the statuses of the film of the replaceable ink cartridge before and after the ink cartridge is forcefully pressed directly into the dispensing unit.

How the first embodiment of the present invention is alternatively operated is shown in FIGS. 10, 2, and 5, indicating a process of installing the replaceable ink cartridge 40 by means of forceful pressing. When the replaceable ink cartridge 40 of the writing tool runs out of ink, the replaceable ink cartridge 40 can be removed from the writing tool and replaced by another replaceable ink cartridge (not shown) as recited hereinafter.

Referring to FIG. 10, while the replaceable ink cartridge 40 is directly pressed forcefully and downwardly toward the two cutting portions 321 of the inbound part 32, the film 42 can be pierced and cut by either or both of the first ends of the cutting portions 321. After that, the ink can flow into the dispensing passage 33 of the dispensing unit 30 from the replaceable ink cartridge 40 and then guided to the capillary member 20 and the nib 12 via the outbound part 31, so the ink can be dispensed fluently for smooth writing. Referring to FIG. 5, the cap 50 is finally screwed into the tube 11, so the assembly of the writing tool is completed.

Figure 11:
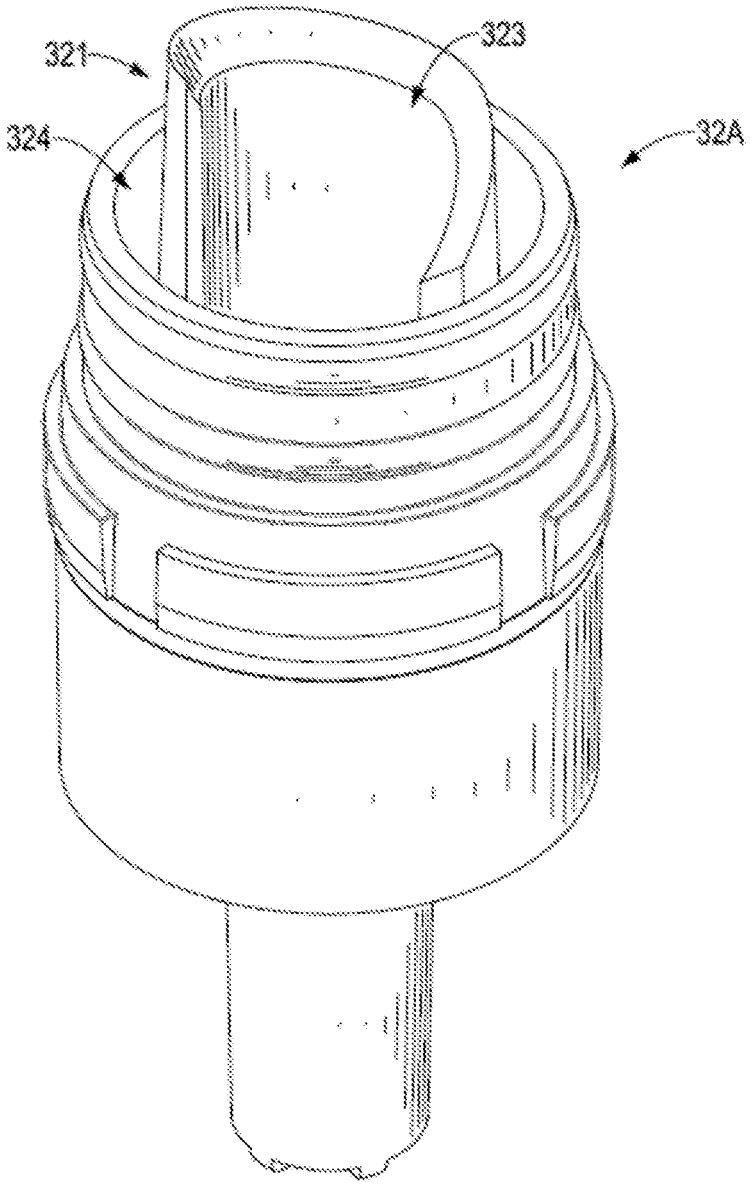
FIG. 11 is a perspective view of the dispensing unit of the writing tool in accordance with a second embodiment of the present invention.

Referring to FIG. 11, a second embodiment of the present invention is similar to the first embodiment of the present invention and has the following difference therefrom. The inbound part 32A has nothing but one said cutting portion 321, whose shape is substantially the same as that of either of the cutting portions 321 of the first embodiment. The internal passage 323 is surrounded by the cutting portion 321. The external passage 324 surrounds the cutting portion 321. The internal passage 323 communicates with the external passage 324, indicating that the external passage 324 communicates with the dispensing passage 33. Since the other structural features of the second embodiment are the same as those of the first embodiment of the present invention, detailed descriptions thereof are thus omitted.

Figure 12:
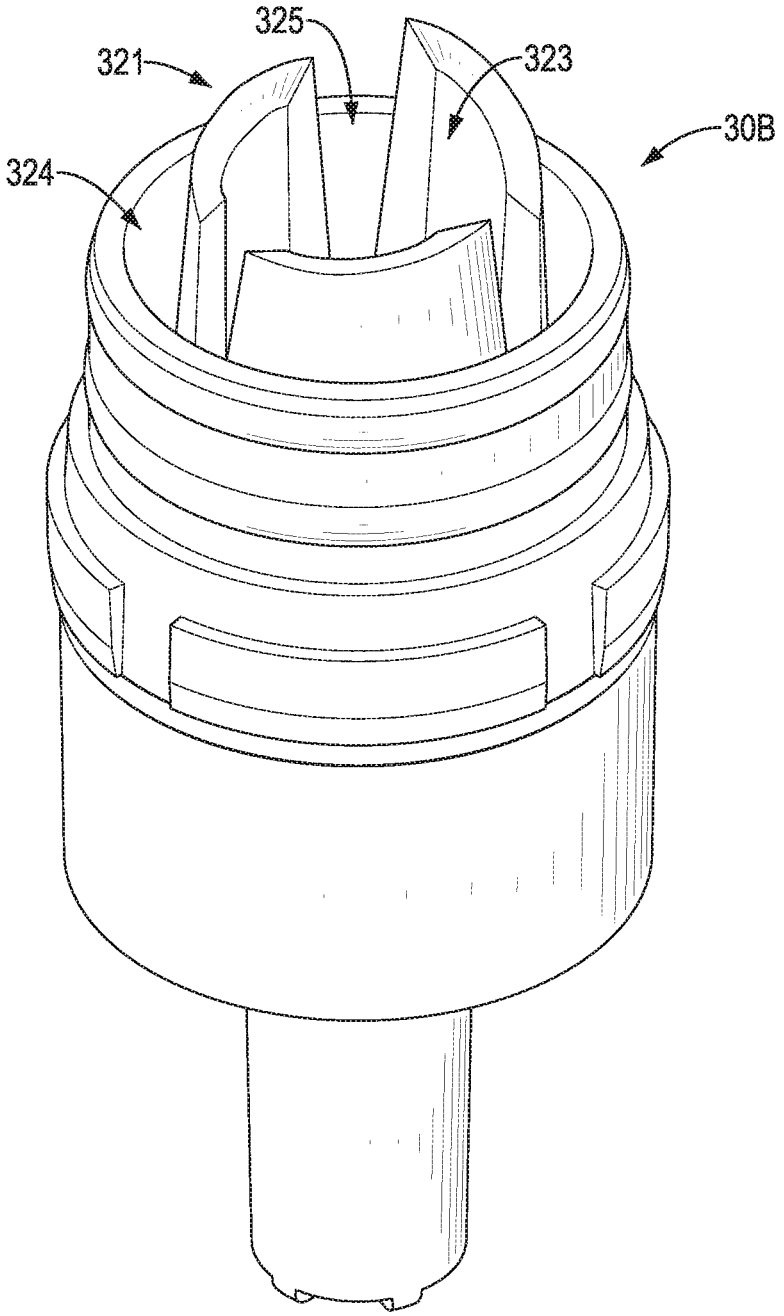
FIG. 12 is a perspective view of the dispensing unit of the writing tool in accordance with a third embodiment of the present invention.

Referring to FIG. 12, a third embodiment of the present invention is similar to the first embodiment of the present invention and has the following difference therefrom. The dispensing unit 30B has three said cutting portions 321, whose shapes are substantially the same as those of the cutting portions 321 of the first embodiment. The internal passage 323 is defined among the cutting portions 321, indicating that the internal passage 323 is surrounded by the cutting portions 321. The external passage 324 surrounds the cutting portions 321 and is located between the cutting portions 321 and the first coupling portion 322. Three said guiding gaps 325 are formed and communicate with the internal passage 323 and the external passage 324. Since the other structural features are identical to those of the first embodiment of the present invention, detailed descriptions thereof are thus omitted.

The dispensing unit 30 of the present invention forms the at least one cutting portion 321 and the at least one cutting portion 321 forms the at least one cutting edge 3210 for piercing and cutting. The replaceable ink cartridge 40 seals the ink by means of the soft film 42. As the replaceable ink cartridge 40 is mounted onto the dispensing unit 30, the film 42 can be pierced and cut by the at least one cutting portion 321 of the dispensing unit 30, so the ink can be dispensed from the replaceable ink cartridge 40 smoothly into the capillary member 20 and the writing unit 10. Therefore, when it is necessary for a user to replace the replaceable ink cartridge 40 running out of the ink, no residual ink tends to be available nor stain the user's hand. The number, shape, and other structural features of the at least one cutting portion 321 can be changed without any limitation as it depends.

The replaceable ink cartridge 40 can completely cover the dispensing unit 30. Furthermore, the first coupling portion 322 forms the two sealing ribs 3221, and each of the outer diameters of the sealing ribs 3221 is slightly larger than the inner diameter of the second coupling portion 41, so the second coupling portion 41 has to be slightly forced to pass the sealing ribs 3221 in the process of the assembly. In this way, leakage of the ink can be prevented from the dispensing unit 30 in the process of the assembly or replacement of the replaceable ink cartridge 40.

The replaceable ink cartridge 40 can be assembled with the dispensing unit 30 by the threaded connection or the forceful pressing. After the film 42 of the replaceable ink cartridge 40 is pierced and cut by the dispensing unit 30, the film 42 still can remain on the stepped edge 411 of the replaceable ink cartridge 40. This prevents the film 42 stained with residual ink from falling off the replaceable ink cartridge 40, thereby avoiding dirtying the user's hand or any nearby object when the replaceable ink cartridge 40 is being replaced. The film 42 having residual ink can be discarded or recycled together with the replaceable ink cartridge 40.

In addition, when the replaceable ink cartridge 40 is mounted on the dispensing unit 30, the dispensing unit 30 has the external passage 324 between the at least one cutting portion 321 and the first coupling portion 322 for guiding the ink and the location of the at least one cutting portion 321 is far away from the first coupling portion 322, so the at least one cutting portion 321 can be prevented from interfering with the stepped edge 411 of the replaceable ink cartridge 40 in the process of the assembly, thereby protecting the at least one cutting portion 321 from damage.

Even though numerous characteristics and advantages of the present invention have been set forth in the foregoing descriptions, together with details of the structure and function of the present invention, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A writing tool, comprising:

a writing unit having a tube and a nib mounted at an end of the tube;

a capillary member mounted in the tube and contacting the nib;

a dispensing unit mounted in the tube and having an inbound part having at least one cutting portion, a first coupling portion, and an external passage, the at least one cutting portion having at least one cutting edge formed on a top thereof, the first coupling portion surrounding the at least one cutting portion, the external passage being defined between the at least one cutting portion and the first coupling portion;

an outbound part contacting the capillary member; and a dispensing passage communicating with the outbound part, the inbound part, and the external passage; and a replaceable ink cartridge mounted in the tube and communicating with the dispensing unit, the replaceable ink cartridge having a second coupling portion connected with the first coupling portion; ink contained in the replaceable ink cartridge; and a film cut by the at least one cutting edge for output of the ink;

wherein the at least one cutting edge comprises at least one first end and at least one second end, and a height difference is defined between the at least one first end and the at least one second end;

wherein the dispensing unit comprises a second cutting portion, and wherein the second cutting portion and the at least one cutting portions are arranged annularly and and spaced at intervals about a dispensing passage.

2. The writing tool as claimed in claim 1, wherein the first coupling portion comprises an abutting edge annularly formed at an outer periphery thereof and defines an assembly stroke being an axial distance between the abutting edge and an uppermost side of the first coupling portion, the assembly stroke being larger than the height difference of the at least one cutting portion.

3. The writing tool as claimed in claim 1, wherein each said cutting edges of the at least one cutting portions is curved and inclined from the at least one first end to the at least one second end.

4. The writing tool as claimed in claim 1, wherein the dispensing passage comprises an internal passage surrounded by the cutting portions and communicating with the external passage via at least two guiding gaps.

5. The writing tool as claimed in claim 1, wherein the at least one cutting edge is curved and inclined from the at least one first end to the at least one second end.

6. The writing tool as claimed in claim 1, wherein the dispensing passage comprises an internal passage surrounded by the at least one cutting portion and communicating with the external passage via at least one guiding gap.

7. The writing tool as claimed in claim 1, wherein the first coupling portion of the inbound part comprises at least one sealing rib, an outer diameter of the at least one sealing rib being not smaller than an inner diameter of the second coupling portion.

8. The writing tool as claimed in claim 1 further comprising a cap sleeved onto the replaceable ink cartridge for rotatably driving and enabling the replaceable ink cartridge to be installed into the tube.

9. The writing tool as claimed in claim 8, wherein the cap comprises a plurality of push lugs formed annularly at a lowermost side thereof and spaced at intervals;

the second coupling portion comprises a plurality of abutting ribs formed annularly at an outer periphery of the replaceable ink cartridge and spaced at intervals; and the cap rotatably drives the replaceable ink cartridge into the tube in such a way that the push lugs are pushed against the abutting ribs, respectively.

10. A dispensing unit of a writing tool, the writing tool having a capillary member, a tube, and a replaceable ink cartridge, the dispensing unit being mounted in the tube and comprising:

an outbound part contacting the capillary member;

an inbound part having at least one cutting portion having at least one cutting edge formed on a top thereof;

a first coupling portion surrounding the at least one cutting portion; and an external passage defined between the at least one cutting portion and the first coupling portion; and a dispensing passage communicating with the outbound part, the inbound part, and the external passage;

wherein the at least one cutting edge comprises at least one first end and at least one second end, and a height difference is defined between the at least one first end and the at least one second end;

wherein the dispensing unit comprises a second cutting portion, and wherein the second cutting portion and the at least one cutting portion are arranged annularly and spaced at intervals about a dispensing passage.

11. The dispensing unit of the writing tool as claimed in claim 10, wherein the first coupling portion comprises an abutting edge annularly formed at an outer periphery thereof and defines an assembly stroke being an axial distance between the abutting edge and an uppermost side of the first coupling portion, the assembly stroke being larger than the height difference of the at least one cutting portion.

12. The dispensing unit of the writing tool as claimed in claim 10, wherein each said cutting edges of the at least one cutting portions is curved and inclined from the at least one first end to the at least one second end.

13. The dispensing unit of the writing tool as claimed in claim 10, wherein the dispensing passage comprises an internal passage surrounded by the cutting portions, and the internal passage communicates with the external passage via at least two guiding gaps.

14. The dispensing unit of the writing tool as claimed in claim 10, wherein the at least one cutting edge is curved and inclined from the at least one first end to the at least one second end.

15. The dispensing unit of the writing tool as claimed in claim 10, wherein the dispensing passage comprises an internal passage surrounded by the at least one cutting portion, and the internal passage communicates with the external passage by at least one guiding gap.

16. The dispensing unit of the writing tool as claimed in claim 10, wherein the replaceable ink cartridge comprises a second coupling portion sleeved onto the first coupling portion of the inbound part, the first coupling portion comprises at least one sealing rib, and an outer diameter of the at least one sealing rib is not smaller than an inner diameter of the second coupling portion.

* * * * *